United States Patent [19]

Stack

[11] Patent Number: 4,850,483

[45] Date of Patent: Jul. 25, 1989

[54] GOLF ACCESSORY HOLDER

[76] Inventor: Denis M. Stack, P.O. Box 27163, Seattle, Wash. 98125

[21] Appl. No.: 60,643

[22] Filed: Jun. 11, 1987

[51] Int. Cl.[4] ..... B65D 85/00; A63B 57/00

[52] U.S. Cl. ..... 206/315.9; 224/919; 273/32 D; 273/32 A; 273/32 B; 273/DIG. 12

[58] Field of Search ..... 273/32 R, 32 B, 32 D, 273/33 R, 162 F; 206/315.9, 315.5, 315.8; 224/918, 919, 274; 221/65, 255, 256, 257

[56] References Cited

U.S. PATENT DOCUMENTS

| | | | |
|---|---|---|---|
| 1,778,225 | 10/1930 | Morss | 206/315.9 |
| 2,112,339 | 3/1938 | Kasparek | 224/918 |
| 2,768,775 | 10/1956 | Houser | 224/919 |
| 3,289,928 | 9/1965 | Gould | 273/32 D |
| 3,497,118 | 2/1970 | Najjar | 224/919 |
| 3,497,676 | 2/1970 | Gravatt | 224/918 |
| 4,082,209 | 4/1978 | Sanders | 224/919 |
| 4,106,678 | 8/1978 | Thomas | 206/315.9 X |
| 4,299,345 | 11/1981 | Lanzyl | 224/919 X |
| 4,629,235 | 12/1986 | Logue | 221/65 X |
| 4,678,108 | 7/1987 | Inman | 224/919 |
| 4,730,728 | 3/1988 | Larkin | 206/315.9 |

*Primary Examiner*—Richard C. Pinkham
*Assistant Examiner*—William E. Stoll
*Attorney, Agent, or Firm*—Harry M. Cross, Jr.

[57] ABSTRACT

A golf accessory holder for golf balls, tees and the like is formed of an elastomeric thermoplastic rubber. The holder provides a cylindrical opening for at least two golf balls, an upper reinforcing rim with provision for tees and an external reinforcing spine with provision for tees.

7 Claims, 2 Drawing Sheets

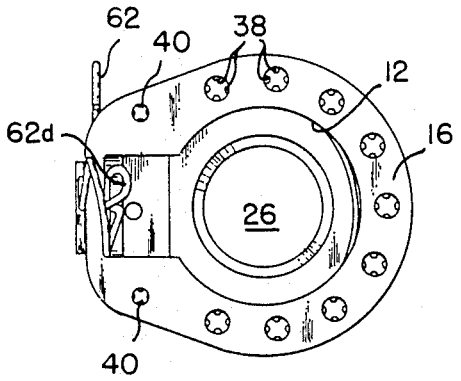
FIG. 6
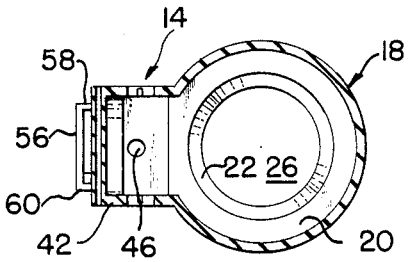
FIG. 7
FIG. 8
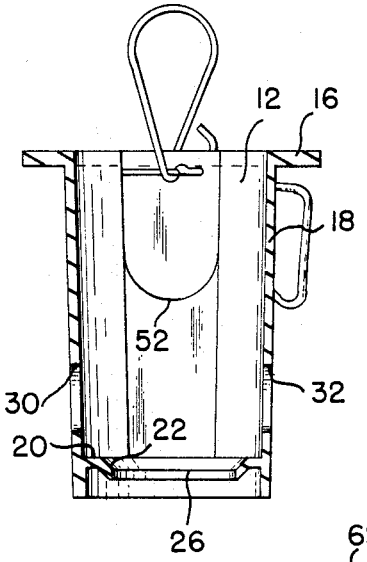
FIG. 9
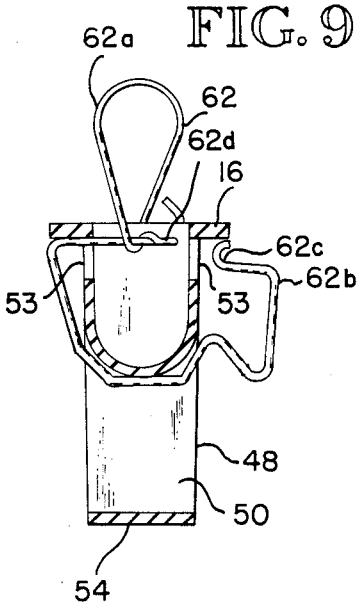
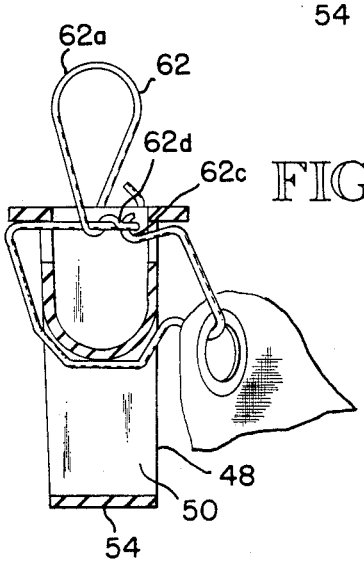
FIG. 10

GOLF ACCESSORY HOLDER

FIELD OF THE INVENTION

This invention relates to golfer's accessories, and it particularly relates to devices intended to be attached to a golfer's person, golf bag or golf cart for holding golf balls, tees, green repair tool, ball markers and golf towel.

BACKGROUND OF THE INVENTION

Although any number of golf ball and golf accessory holders have been proposed, none organize all the above mentioned accessories in one compact light package. They often are difficult to use or install or become unfit for further use and are not articulate enough to be worn on the person, golf bag or golf cart with the advantage of being attached and removed instantly. Even though made of plastic or plastic-type materials, these prior devices will over time often loose their elasticity and become dysfunctional. Moreover, they often are difficult to manufacture or assemble and consequently are too expensive. Others are too bulky and cumbersome.

SUMMARY OF THE INVENTION

The gold accessory holder and organizer of this invention is generally cylindrical in form and preferably holds two golf balls, one on top of the other. The holder is molded with a longitudinal external spine that supports the ball-holding cylinder and carries additional golf accessories such as tees and a green repair tool. The upper end of the ball-holding cylinder is provided with a reinforcing rim which can also hold golf accessories such as tees and ball-spotting markers. A wire retainer is secured to the spine for attaching the holder to a golfer's belt, belt loop, golf bag or golf cart. The holder is preferably fabricated from an injection-moldable elastomer.

BRIEF DESCRIPTION OF THE DRAWINGS

FIG. 6 is a top plan view of the holder;

FIG. 7 is a cross-section taken along the line 7—7 of FIG. 3, but rotated 180°;

FIG. 8 is a cross-section taken along the line 8—8 of FIG. 3;

FIG. 9 is a cross-section taken along the line 9—9 of FIG. 3; and

FIG. 10 is a view similar to FIG. 9 with a towel attached to the wire clip and the clip shown in a closed condition.

DETAILED DESCRIPTION OF THE INVENTION

Figure 1:
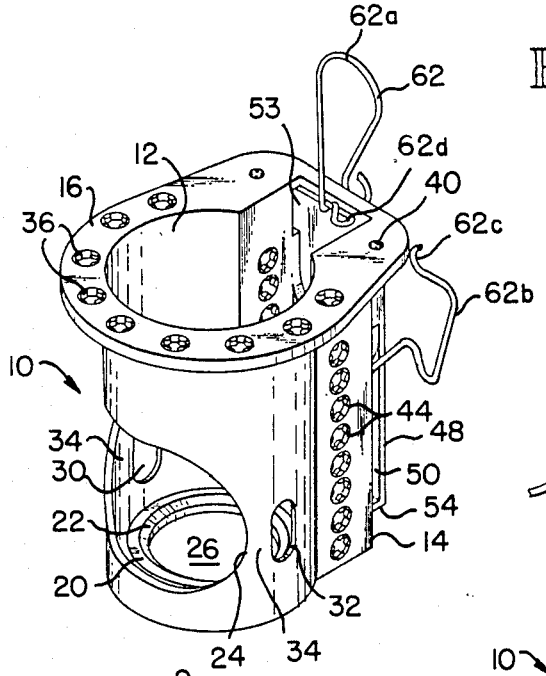
FIG. 1 is a perspective view of the golf accessory holder of this invention.
Figure 2:
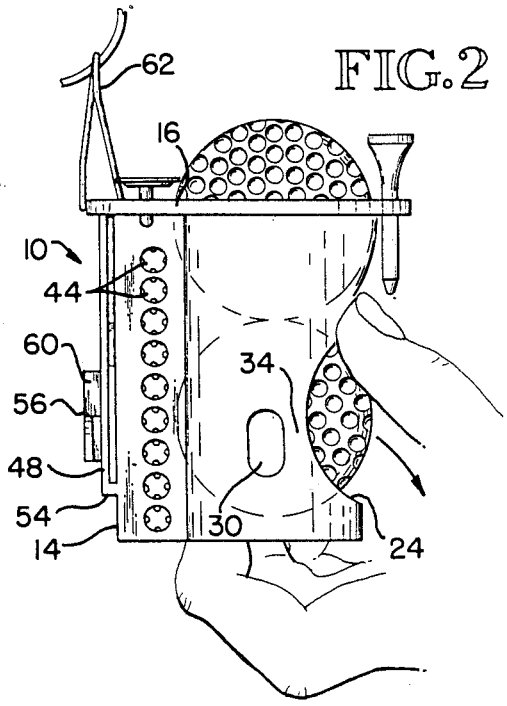
FIG. 2 is a side elevation view of the holder, illustrating its use.
Figure 3:
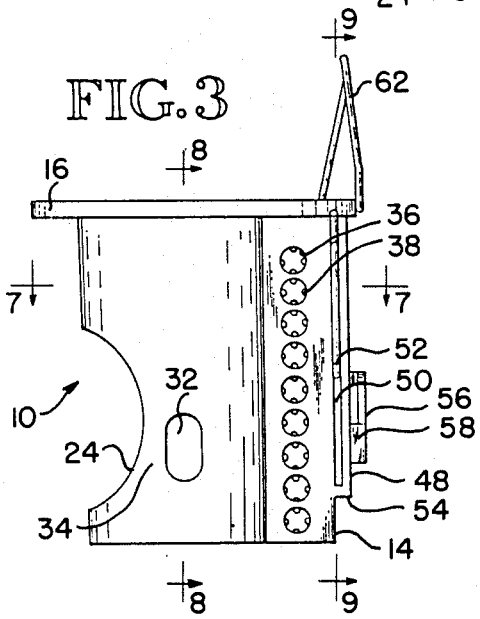
FIG. 3 is an opposite side elevation view of the holder.
Figure 4:
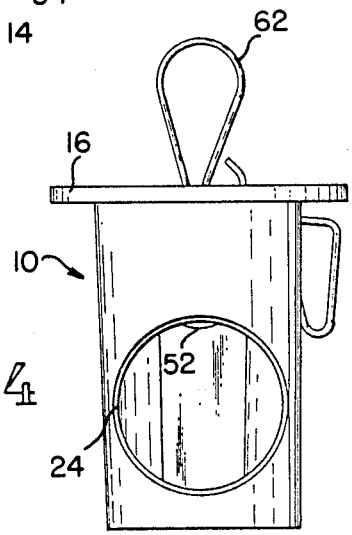
FIG. 4 is a front elevation view of the holder.
Figure 5:
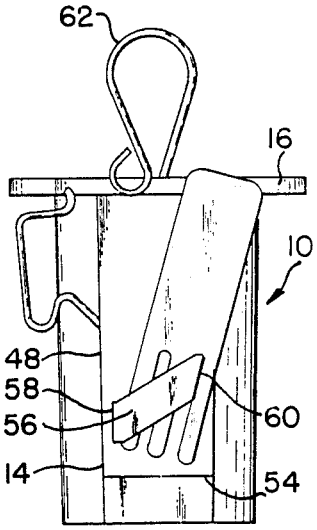
FIG. 5 is a rear elevation view of the holder.

The holder and organizer of this invention comprises a unitary body 10 having a cylindrical passage 12 extending longitudinally through the body, an external spine 14 and an upper reinforcing rim 16. The body portion defining circumferential wall 18 of passage 12 is relatively thin so that the side wall is flexible and elastic.

The lower end of the golf ball-containing cavity defined by passage 12 is closed by an annular ring 20.

Ring 20 has a contoured upper rim surface 22 shaped to engage the concave surface of a golf ball. Ring 20 reinforces the lower portion of the ball cavity in addition to providing the ball seat. The forward or front side of the lower half of the ball cavity wall 18 is provided with a ball discharge aperture 24 as shown. A golf ball supported by ring 20 may be removed through aperture 24 by grasping the ball through the bottom opening 26 defined by ring 20 and 22 and the side opening 24, and rotating or twisting the ball out through the front opening 24.

Upper rim 16 overlays spine 14 and encircles the upper end of the ball cavity wall 18. The top opening through rim 16 into the body cavity has a diameter slightly smaller than the diameter of a golf ball so that a slight force must be applied to insert a ball into the body cavity. The cylindrical passage side wall 18 tapers about 1° inward from the top rim opening to the lower ball support ring 20 and 22. This taper helps insure that a ball will be completely circumferentially engaged by side wall 18 throughout the length of passage 12. The height of passage 12 is at least sightly greater than 1½ ball diameters plus one ball diameter for every ball over two to be stored therein at one time. The preferred height is just slightly over 1½ ball diameters for storage of two balls at one time as shown.

Side slots 30, 32 are provided on opposite sides of the side wall 18 to facilitate side wall flexing as a ball is inserted, moved downward, or rotated out of passage 12. The lower pair of slots are centered at such an elevation as to provide a pair of wall webs 34 adjacent discharge aperture 24 from about the ball midpoint downward. These wall webs will flex to permit the aperture 24 to expand sufficiently as a ball is removed therethrough. An upper pair of slots may be added at an elevation coinciding with the positions of an upper ball.

The upper reinforcing rim 16 has a plurality of vertical tee holes 36 therein. The tee holes are circular are provided with four inwardly protruding longitudinal ribs 38. Ribs 38 are spaced around each hole at 90° intervals. Tee holes 36 have a slightly greater diameter than the diameter of the average tee shank. Ribs 34 protrude into the hole interior far enough to insure that they will engage a tee shank substantially throughout the tee shank's length. By this arrangement, tee holes 36 will securely hold tees, even if the holder of this invention is dropped, jarred or shaken. If a tee tends to be jarred or shaken out, the tee hole ribs 38 will still adequately securely engage the tee shank. A pair of smaller, ball marker holes 40 are located on the back portion of rim 16 on opposite sides of spine 14. The marker holes 40 are configured the same as tee holes 36, only smaller in diameter. The thickness of rim 16 is about 3 times the thickness of body side wall 18.

Body side wall 18 extends through an arc of about 288°, from one intersecting edge of spine wall 42 around to the other intersecting edge. Spin wall 42 defines a three-sided channel at the back of cylindrical passage 12. This channel opens into the cylindrical passage. This arrangement permits rim 16 to flex and expand when a ball is inserted into passage 12. The opposing side portions of spine wall 42 are provided with a plurality of aligned tee holes 44. These spine tee holes are configured identically to rim tee holes 36, and function in the same manner. The wall thickness of spine wall 42 is about 1½ times the thickness of body side wall 18. The bottom portion of spine wall 42 closes off the bottom of the spine channel and is provided with a body cavity hole 46 therethrough.

Bottom support ring 20 is a continuation of the bottom portion of spine wall 42. Ring 20 comprises a cylindrical sidewall with rim surface 22 extending inward but raised above the base of spine wall 42 and side wall 18. Consequently the underside of the lowermost ball will be supported above the bottom edge of the holder, out of contact with a flat surface that the holder might be set upon.

The lower half of the back portion of spine wall 42 is inset from the upper half as shown. A downward extension of the upper half provides a spine web 48. Web 48 stands out from the lower half of the spine back wall portion to provide a pocket slot 50 therebetween. The upper edge 52 of pocket slot 50 is concave downward as shown. This edge 52 provides the transition between the upper and lower halves of the spine wall back portion. The lower edge 54 of slot 50 connects web 48 with the lower half of the spine wall back portion. An integral tool strap 56 extends across the outer face of web 48 at an acute angle. Strap 56 is connected at its lower end to web 48 by a vertical wall stub 58 and at its upper end by a wall stub 60 angled acutely upward at about 75°. One leg of a two or three pronged green repair tool can be inserted beneath tool straps 56 and oriented more or less upright by wall stubs 58 and 60 as shown.

A stainless steel wire clip 62 is so configured as to extend through pocket slot 50, around upper edge 52, through an upper pocket slot 53, forming eye **62*d* and terminate in an upstanding belt or belt loop-engaging portion 62*a*. The other end of clip 62 extends from the lower portion of pocket slot 50 and is so configured as to form in a hand towel hanger 62*b* and terminate in hook 62*c* which clips to eye 62*d* back through slot 53 completing a closed, secure quick release loop as shown in FIG. 9**.

The holder of this invention is preferably injection molded. A preferred material is a synthetic fully cross-linked thermoplastic elastomeric polymer such as SANTOPRENE brand PROPYLENE-EDPM blend thermoplastic elastomer provided by Monsanto Company, of Shore hardness 64 A durometer. The preferred embodiment made of SANTOPRENE elastomer weighs about one ounce. This material exhibits substantially improved resistance to compression set, low and high temperature elasticity, and high temperature tensile properties. Other elastomers such as PVC, EDPM or equivalents could be used.

While a preferred embodiment of a golf accessory holder, made in accordance with the principles of the present invention, has been described and illustrated, certain changes may be made without departing from the scope of the invention.

What is claimed is:

1. A unitary golf accessory holder made of elastomeric material and comprising a body having a cylindrical wall defining a golf ball passage therein, an external longitudinal spine integral with said cylindrical wall and having a channel shaped wall, and an overlaying upper reinforcing partial annular rim forming an incomplete ring from which said spine and said cylindrical wall depend, the sides of said channel shaped spine wall joining adjacent edges of said rim whereby said rim may expand when a golf ball is inserted therethrough into said passage and contract back to its relaxed state after golf ball insertion; said cylindrical wall having a ball discharge aperture therein oriented on the opposite side of said passage from said spine.

2. The holder of claim 1 wherein tee holes are provided in said body of circular configuration with longitudinal tee-contacting ribs provided in the interior circular walls of said holes, parallel to the axis of said holes, whereby golf tees are gripped within said tee holes by said tee-contacting ribs within said tee holes over a substantial portion of their shanks when inserted and extracted.

3. The holder of claim 1 wherein said body includes a bottom ball support ring at the bottom of said passage, said ring having an annular ball support surface elevated above the base of said body whereby the underside of a golf ball supported by said ring will not protrude below the bottom edge of said holder; and wherein the channel-shaped wall of said spine extends from said rim to said bottom ball support ring, and said cylindrical wall is partially incomplete with adjacent longitudinal sides thereof joined by the sides of said channel-shaped spine wall with the spine channel opening into said golf ball passage whereby said cylindrical wall can expand when a golf ball is inserted therein.

4. The holder of claim 3 wherein a vertical plurality of transversely-oriented tee holes are provided in said spine and arranged in pairs with one set of holes in one spine side wall portion and another set of holes in the opposing spine side wall portion, the holes of each pair being axially aligned.

5. The holder of claim 1 including a wire clip secured to said spine for attaching said holder to a belt, belt loop, golf bag or golf cart, said wire clip having an upper loop portion extending above said holder configured for attaching said holder, and having a lower portion configured to extend from said upper portion downwardly through said spine and upwardly toward said upper portion with a terminal end formed as a hook, the point of transition from said upper portion to said lower portion being configured to provide a loop to which said clip hook may be secured; wherein said spine is configured to include a downwardly-exposed ledge which is engaged by said clip lower portion to support said holder body between its top and bottom; and wherein the hook part of said clip lower portion extends outward from said holder body and is so configured to provide a towel carrying section whereby the weight of a towel carried thereby would not be exerted on said holder body but be carried solely by said wire clip.

6. A unitary golf accessory holder made of elastic material and comprising a body wall defining a ball passage therein, an external longitudinal spine integral with said cylindrical wall, and an overlaying upper reinforcing annular rim from which said spine and said cylindrical wall depend; said passage being configured to hold at least two golf balls, one on top of the other; said wall having a ball discharge aperture therein oriented on the opposite side of said passage from said spine; said rim having a plurality of longitudinally-oriented tee holes extending therethrough; and a wire clip secured to said spine for attaching said holder to a belt, belt loop, golf bag or golf cart; said tee holes being provided with internal longitudinal tee-contacting ribs whereby golf tees are gripped within said tee holes over a substantial portion of their shanks when inserted and extracted; a bottom ball support ring at the bottom of said passage, said ring having an annular ball support surface elevated above the base of said body whereby the underside of a golf ball supported by said ring will not protrude below the bottom edge of said holder; and said spine comprising a channel-shaped wall defining a channel open to said passage with the vertical plurality of tee holes in said spine arranged in pairs with one set of holes in one spine wall portion and the other set of holes in the opposing spine wall portion, the holes of each pair being axially aligned.

7. The holder of claim 6 wherein said wire clip has an upper loop portion extending above said holder configured for attaching said holder, and has a lower portion configured to extend from said upper portion downwardly through said spine and upwardly toward said upper portion with a terminal end formed as a hook, the point of transition from said upper portion to said lower portion being configured to provide a loop to which said clip hook may be secured; wherein said spine is configured to include a downwardly-exposed ledge which is engaged by said clip lower portion to support said holder body between its top and bottom; and wherein the hook part of said clip lower portion extends outward from said holder body and is so configured to provide a towel carrying section whereby the weight of a towel carried thereby would not be exerted on said holder body but be carried solely by said wire clip.

* * * * *